US006324799B1

(12) United States Patent
Salvitti

(10) Patent No.: US 6,324,799 B1
(45) Date of Patent: Dec. 4, 2001

(54) COVING AND METHOD

(75) Inventor: John Salvitti, Wandin (AU)

(73) Assignee: Surecove PTY LTD, Victoria (AU)

( * ) Notice: Subject to any disclaimer, the term of this patent is extended or adjusted under 35 U.S.C. 154(b) by 0 days.

(21) Appl. No.: 09/509,082

(22) PCT Filed: Sep. 22, 1998

(86) PCT No.: PCT/AU98/00789

§ 371 Date: Mar. 22, 2000

§ 102(e) Date: Mar. 22, 2000

(87) PCT Pub. No.: WO99/15740

PCT Pub. Date: Apr. 1, 1999

(30) Foreign Application Priority Data

Sep. 22, 1997 (AU) ..... PO 9320

(51) Int. Cl.[7] ..... E04B 2/00

(52) U.S. Cl. ..... 52/287.1; 52/745.21; 52/742.14; 52/294

(58) Field of Search ..... 52/287.1, 288.1, 52/293.3, 295, 294, 742.14, 742.15, 745.21; 249/5, 34, 208

(56) References Cited

U.S. PATENT DOCUMENTS 4,601,149 * 7/1986 Dokan ..... 52/287
5,010,703 * 4/1991 Pearlman ..... 52/288
6,122,872 * 9/2000 Sauter ..... 52/288.1

FOREIGN PATENT DOCUMENTS 264142 6/1964 (AU) .
A761906 3/1997 (EP) .
93/06319 * 4/1993 (GB) ..... E04F/19/04
A2300656 11/1996 (GB) .
A9306319 4/1993 (WO) .

* cited by examiner

*Primary Examiner*—Carl D. Friedman
*Assistant Examiner*—L. B. Porterie, Jr.
(74) *Attorney, Agent, or Firm*—Birch, Stewart, Kolasch & Birch, LLP

(57) ABSTRACT

A preformed coving (1) suitable for casting into a bund wall (69), said coving (1) including: a base portion (3) positionable on or in close proximity to a floor (37) and having a concave curved front face (5) and a dependent flange (11) adapted for location in a recess in said floor; a wall portion (7) having a front face (9); and attachment means (23) remote from said front faces adapted to receive a fixing device (47) for securing said coving (1) to said floor (37). The coving (1) may further include support means (31) to receive a support and/or spacer element (57) to support a reinforcing rod (67) to be cast into the bund wall (69) or to space one coving from another when the bund wall (69) requires a coving on each of its sides.

15 Claims, 7 Drawing Sheets

COVING AND METHOD

This application is the national phase under 35 U.S.C. §371 of PCT International Application No. PCT/AU98/00789 which has an International filing date of Sep. 22, 1998, which designated the United States of America.

The present invention relates to an apparatus and method relating to building construction, in particular it relates to apparatus for use in construction of the base portion of a wall in certain applications and a method for construction of such a wall. It will be convenient to describe the invention with particular reference to construction of a bund wall formed during concrete fabrication procedures, although it will be appreciated that the invention may have wider application.

In the construction of certain buildings having special requirements for hygiene, in particular in the construction of hospitals or buildings where food preparation, treatment, storage and handling is carried out, health and building regulations dictate that at the junction of walls and floors of particular rooms the vertical wall and horizontal floor at their junction meet as a curve rather than an intersection of two planes. These regulations require that a radiused coving must be provided at such junctions. The purpose of such coving is for hygiene purposes. It has been recognised that cleaning of a radiused wall and floor junction is far more efficient at preventing build-up of spilled food or other waste which may find its way onto the walls or floor and thus eliminates bacterial contamination which may otherwise present a hazard to, for example, food being manufactured or processed otherwise to the sterility of the room. If the walls and floor meet at a non-radiused right-angle, cleaning is significantly harder because of the reduced access to the junction, particularly when cleaning involves mopping or scrubbing of the walls and floor and this lack of access can lead to a build up of food wastes which may then harbour bacteria which can then penetrate the wall and floor junction. In food processing plants, cold stores, abattoirs or even hospitals if bacterial contamination does so penetrate into the wall cavity, it is very difficult for sterilisation to take place, and in many cases, the premises must be partially demolished to remove that contaminated part of the building.

Conventional methods of constructing the necessary coving generally involve first laying a concrete floor slab, then, once that has adequately cured, placing form work to form a bund wall. A bund wall is a footing or short embankment wall onto which a main structural wall is built. Once the bund wall has been poured and cured, a suitable coving is then shaped at the floor/wall junction by either trowelling cement into the right angle junction and/or applying a prefabricated coving to the floor/wall junction or by laying up an epoxy or similar coving once the wall/floor junction has been formed.

Such known methods of forming a coving either in situ or applying a preformed coving suffer from a number of disadvantages. First, each of the known methods require a number of process steps and in a number of methods, subsequent steps cannot be undertaken until a previous step has fully been completed. For example with most known methods the concrete bund wall must have fully cured before either a cement coving is formed or an epoxy layer is formed against the bund wall. Furthermore, the quality and uniformity of the coving formed in situ often depends upon the skill of an operator in performing the necessary work. Covings often need to perform under extreme conditions. For example, covings are often required in cold stores operating at temperatures of −20° C. or lower, or they may be subjected to high temperatures, for example in abattoirs where hot water at 70° C. or greater is used to clean down floors and walls. Covings are often subjected to physical stress, for example, if forklift trucks or pallet trolleys or other movable objects collide into them.

Accordingly, there is a need for a coving and a method of installing such a coving which can be installed relatively easily and inexpensively and with a high degree of uniformity, can withstand extreme working conditions, can form a suitable barrier against bacteria or contamination and complies with relevant health and construction standards. It is an object of the present invention to provide a coving and a method of construction which satisfies one or more of the above needs.

In accordance with one aspect of the present invention there is provided a preformed coving for casting into a bond wall, said coving including a base portion positionable on or in close proximity to a floor and having a concave curved front face and a substantially vertically planer dependant flange adapted for location in a recess in said floor; a wall portion having a front face; and attachment means remote from said front faces adapted to receive a fixing device for securing said cooing to said floor. Preferably the concave curved front face is a concave radiussed front face.- -

The coving may be of any suitable dimensions and may be of any suitable length. It will be appreciated that because the coving is for use along the junction of a wall and a floor it will preferably be elongate and of any suitable or convenient length. Preferably the coving will be of substantially constant cross-section. The base portion will generally be adapted to be positioned on or about a floor onto which the bund wall is to be constructed.

The base portion includes a substantially vertically planar dependent flange. The dependent flange preferably extends along the entire length of the coving and is adapted to be inserted in to a recess in the floor in relation to which the coving is to be utilized. The dependent flange may be positioned on the base portion anywhere proximate to where the base portion comes close to contacting or contacts the portion of the floor in relation to which the coving is to be utilized, preferably the dependent flange depends from a front edge of the base portion which is furthest away from the wall portion. Preferably this is the part of the base portion which comes closest to contacting the floor when the coving is in use.

The base portion has a concave curved front face which is preferably radiussed. The radiused front face preferably has a radius of between 20 mm and 60 mm although it will be appreciated by those skilled in the art that other radiuses or degrees of curvature will be acceptable to provide a suitable coving which may comply with relevant health and building standards. The concave front face presents a surface which, when the coving is cast in situ in a bund wall, presents an outward face available for cleaning in compliance with such standards. The base portion may also include a rear face which is not exposed when the coving is positioned in situ. The base portion may also include a foot on a portion of the rear face. Preferably the foot is configured such that it provides a sealing surface tangential to said radiused front face and which extends towards the plane of the wall portion. In a preferred embodiment, the planes of the wall portion and the sealing surface intersect at an angle of greater than 90° C. so that when the wall portion is perpendicular to the floor on which the bund wall is to be formed the sealing surface is angled slightly relative to the floor and inclined away from where the base portion comes closest to the floor.

Preferably the foot is solid in the region between the sealing surface and the radiused front face ie. so no air spaces exist in that region. The foot may further or alternatively include a rear face extending between the sealing surface and the base portion and having a re-entrant lip and lip such that said rear face facilitates avoidance of air spaces at the rear of the coving when concrete or some similar filling material is poured behind the coving.

The coving further includes a wall portion having a front face. Preferably the front face of the wall portion is continuous with the curved front face of the base portion, the base portion and wall portion being continuous. The wall portion may consist of a substantially vertical upstanding elongate member which in use will preferably be substantially perpendicular to the floor. The front face of the wall portion also presents when in situ, an outward face available for cleaning. In one embodiment the wall portion may further include an angled flange on the top of the wall portion remote from the junction of the wall portion and the base portion.

The coving also includes attachment means remote from said front faces adapted to receive a fixing device. In one embodiment said attachment means consists of a flange projecting from a rear face of the coving, optionally having an upwardly turned lip so as to form a channel to engage a corresponding downwardly projecting portion of a corresponding fixing device. In this embodiment the attachment means may be continuous along the length of the coving. The attachment means must be suitable for connection with or cooperation with fixing means so that the coving can be secured into a chosen position and will resist movement from that position even when concrete is being poured behind the coving to form the bund wall. The attachments means may be provided at any convenient location remote from the front faces of the coving, preferably on the rear surface of the coving, more preferably on the rear surface of the wall portion of the coving. The positioning of the attachment means may be varied depending upon the calculated forces which may be applied to the coving when in use.

The coving may further include support means remote from said front faces adapted to receive a support and/or spacer element to support for example a reinforcing rod to be cast into the bund wall, and/or to space one coving from another coving when the bund wall requires a coving on each of tits sides. The support may consist of a flange projecting from a rear face of the coving, optionally having an upwardly turned lip. The support means may be continuous along the length of coving, or alternatively they may be positioned periodically along the length of the coving.

The attachment means and support means may act to key the coving into position and hold the coving into the concrete bund wall once the poured concrete has been cured.

In another aspect of the invention there is provided a formwork system for forming a coved wall on a surface, said system including: a coving including a base portion having a concave curved front face;

a wall portion having a front face; and attachment means remote from said front faces adapted to receive a fixing device; and a fixing device co-operable with said attachment means and securable to said surface to secure said coving in position on said surface.

The features of the coving have previously been described.

The fixing device may be any suitable device which can cooperate or connect with the attachment means so as to secure the coving in a fixed position but without interfering with the front faces of the coving. In one embodiment where the attachment means consists of a channel projecting from a rear face of the coving, fixing means may consist of a bracket having a portion to adapted to engage in said channel joined to another portion adapted to receive a fastening device such as a bolt which may be secured into the surface onto which the coving is positioned. Other alternative arrangements for the fixing device to secure the coving by way of the attachment means may be utilised provided that the fixing device and attachment means do not interfere with the front faces of the coving.

In a preferred embodiment the fixing device holds the coving in a desired position and the coving then acts as a non-removable formwork for the formation of the bund wall.

In one embodiment where two covings are required to be provided, a fixing device may include two engagement portions, each portion adapted to engage the attachment means of the coving and to space the covings apart to a desired distance. A plurality of fixing devices may be provided along the length of the coving. The coving may also include a secondary attachment means capable of supporting a spacer element. The configuration of the secondary attachment means may be similar to the attachment means adapted to receive a fixing device.

In another embodiment of the invention there is provided a method of forming a bund wall including the steps of:

a) providing a preformed coving which includes a base portion having a concave curved front face; a wall portion having a front face and attachment means remote from said front faces adapted to receive a fixing device;

b) positioning said coving on said surface with said front faces displayed outwardly;

c) securing said coving to said surface by one or more fixing devices attached to said attachment means and said surface;

d) providing additional formwork adjacent to said coving to form a space between the rear of said coving and said formwork; and e) providing infill into said space.

In a preferred embodiment where the coving includes a dependent flange there is also provided the steps of forming a recess in the surface and then, positioning said dependent flange in said recess when positioning said coving on said surface.

In another embodiment of the provision of additional formwork to form the space will be by way of providing another coving so that the rear portion of the two covings form the space to be filled. It will be appreciated that the formwork will most commonly be used for concrete fabrication, although the method may equally be appropriate for use where any other 'fill' material eg polymeric foam, is utilised to fill the space.

Where two covings are used back to back, the method may include the additional steps of positioning one or more spacer means along the length of the covings, and optionally positioning a reinforcing member on said spacer means. In one embodiment the fixing device(s) may be configured to support the reinforcing rod and provide a spacer function as well.

The method preferably includes the steps of applying a sealing material in the recess in the surface prior to positioning the flange of the coving therein.

The invention will be now described in more detail with reference to a preferred embodiment illustrated in the accompanying drawings. It is to be understood that the drawings and the following description relate to a preferred embodiment only and are not intended to limit the scope of the present invention.

Figure 1:
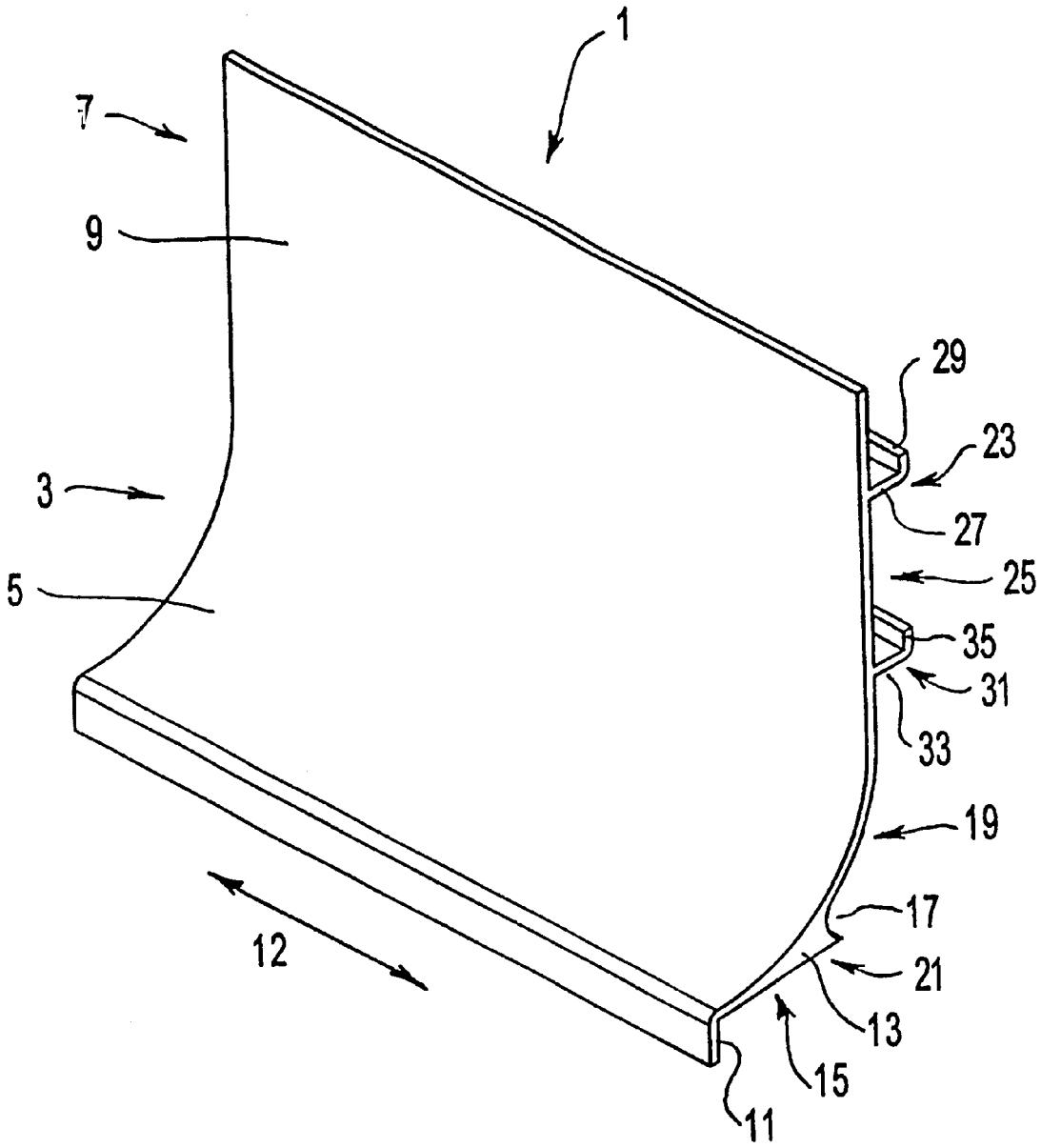
FIG. 1 is a perspective view of a portion of a coving of typical profile made in accordance with the present invention.

In FIG. 1 the coving 1 consists of a base portion 3 which has a concave radiused front face 5. Coving 1 also has a wall portion 7 which has a front face 9. Front faces 5 and 9 are continuous ie. there is no discernible line where front face ends and front face 9 starts. Importantly, front faces 5 and 9 collectively present an outward facing surface which can be readily cleaned when the coving is positioned in situ. Base portion 3 includes flange 11 which extends along the length 12 of coving 1. The plane of flange 11 is substantially parallel to the plane of wall portion 7. Base portion 3 also includes a foot 13 which has a sealing surface 15. Sealing surface 15 is tangential to concave front face 5. Foot 13 further includes a rear face 17 which extends from sealing surface 15 towards a rear face 19 of base portion 3. Foot 13 is solid ie. does not include any void space therein. Preferably rear face 17 is concave and has a re-entrant lip 21 which facilitates flow of a filling about rear faces 17 and 19.

Coving 1 has an attachment ledge 23 running along a rear wall portion 25 of coving 1. Attachment ledge 23 consists of a projecting flange 27 and an upturned lip 29.

Coving 1 further includes a support ledge 31 comprising a projecting flange 33 and upturned lip 35. Attachment ledges 23 and support ledge 31 are located on rear wall portion 25.

Figure 2:
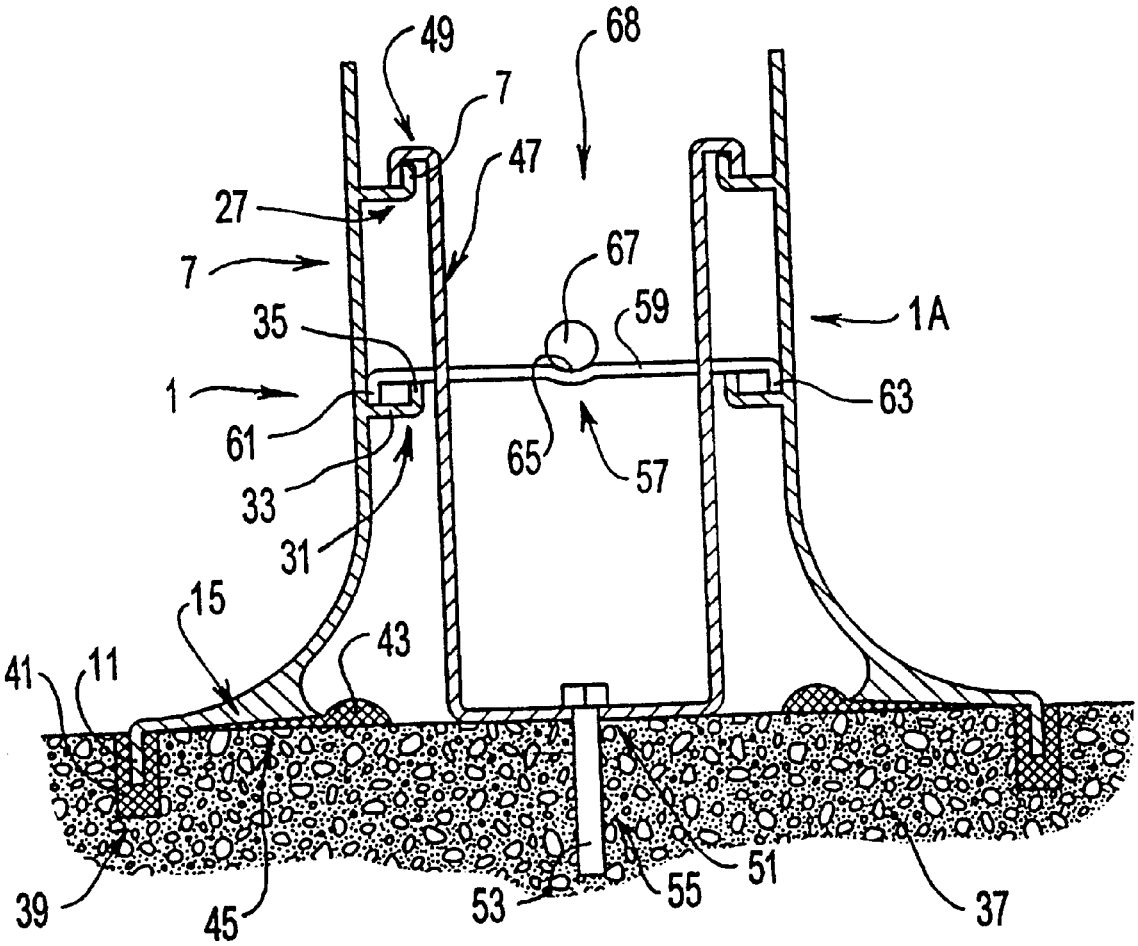
FIG. 2 is a transverse section of a formwork in accordance with the present invention for the formation of a bund wall on a floor surface.
Figure 3:
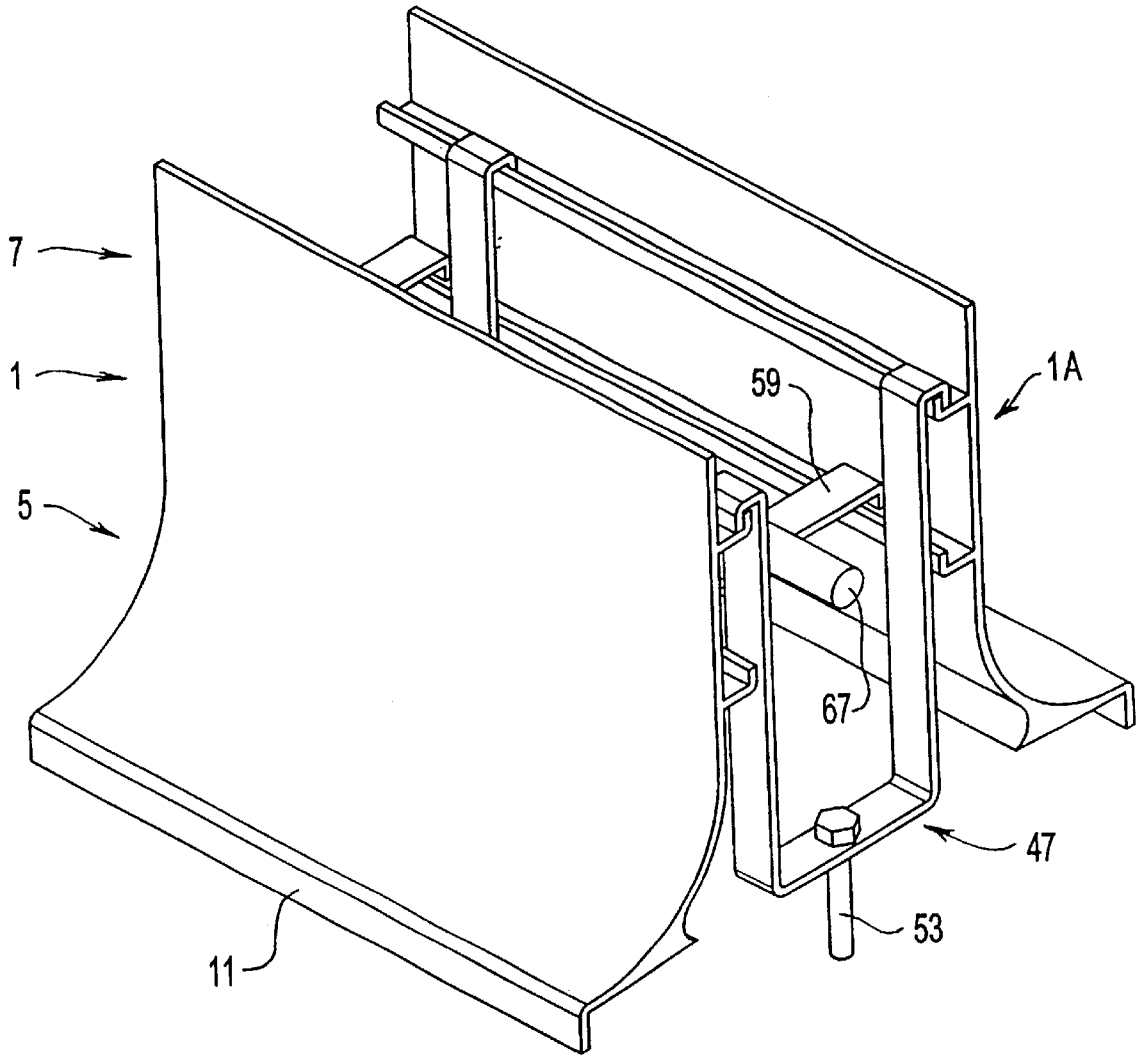
FIG. 3 is a perspective view of a portion of formwork in accordance with the present invention not shown with any surface

Turning to FIGS. 2 and 3, a pair of covings 1 and 1A are shown in a suitable configuration for providing formwork for formation of a bund wall upon floor 37. Covings 1 and 1A are substantially identical and form parts of a wall of a building having two adjacent rooms which both require covings. It will be appreciated that the features shown in coving 1 are identical to those shown in coving 1A but for convenience these features shall be described only in relation to coving 1. Flange 11 is positioned in a recess 39 in floor 37 which has been filled with a sealing compound 41. Further sealing compound 43 has also been applied to floor surface 45 adjacent recess 39. When coving 1 is positioned of floor surface 45 sealing surface 15 contacts sealing compound 43 which is squeezed out of the joint between sealing surface 15 and floor surface 45 and forms a hygienic seal. As sealing surface 15 is not perpendicular to the plane of wall portion 7 ie. the angle between the plane of sealing surface 15 and wall portion 7 is slightly greater than 90°, sealing compound 43 is squeezed away from recess 39 when coving 1 is fixed to the floor surface 45.

Figure 4:
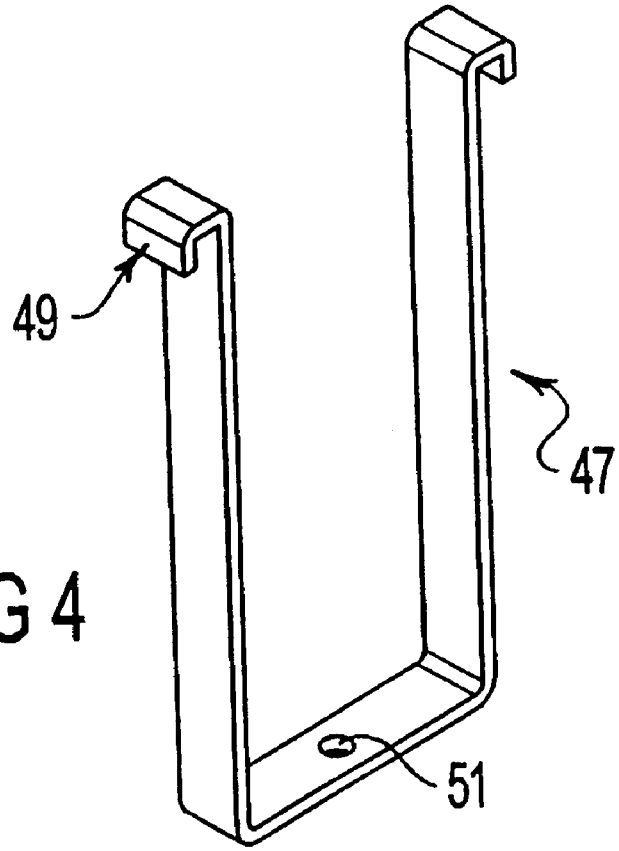
FIG. 4 is a perspective view of a typical bracket of the present invention.
Figure 5:
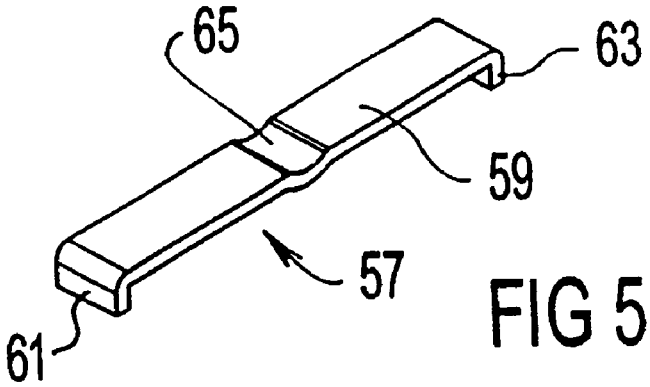
FIG. 5 is a perspective view of a typical spacer of the present invention.

Bracket 47 as shown in more detail in FIG. 4 has overhanging lip 49 which engages with upturned lip 29 of coving 1. Bracket 47 includes opening 51 through which bolt 53 is passed into drill hole 55 in floor 37. Bolt 53 secures bracket 47 to floor 37 and thus coving 1 is securely affixed to floor surface 45. Sealing compounds 41 and 43 may further assist in securing coving 1 to floor 37, although their primary purpose is to form a water-tight seal between coving 1 and floor 37. It will be appreciated that a plurality of brackets 47, 49 may be provided along the length of coving 1 and 1A spaced as desired. Spacer 57 as shown in more detail in FIG. 5 has a body 59 of a desired width suitable to space covings 1 and 1A apart. At opposite ends of body 59 there are provided lips 61 and 63 suitable for engagement with upturned lip 35 and projecting flange 33 of support ledge 31. Body 59 may include cradle 65 suitable for locating reinforcing rod 67 which runs along the length of the wall being formed.

Figure 6:
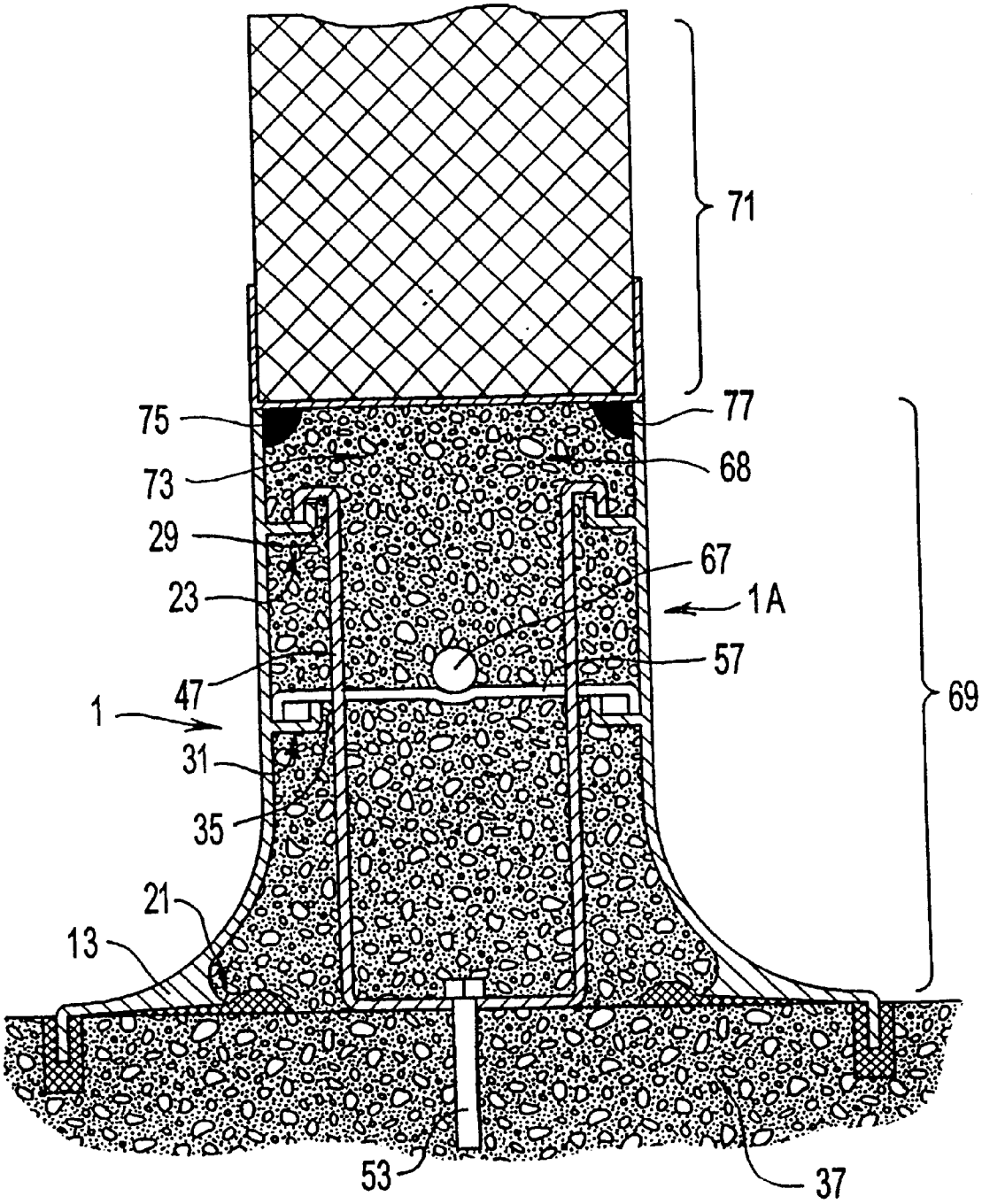
FIG. 6 is a transverse section of a bund wall made in one embodiment of the present invention.

Turning to FIG. 6, bund wall 69 with cast-in covings 1 and 1A is shown supporting structural wall 71 area 68 between covings 1 and 1A and floor 37 is completely in-filled with concrete 73 so that bracket 47, bolt 53, spacer 57 and reinforcing rod 67 are completely embedded in concrete 73. Attachment ledge 23 and support ledge 31 are also embedded in concrete 73 and upturned lips 29 and 35 assist in securing coving 1 into concrete 73. Sealant 75 and 77 is preferably applied to concrete 73 prior to positioning of structural wall 71 on bund wall 69. Re-entrant lip 21 of foot 13 is shaped to assist in the elimination of trapped air spaces when concrete 73 is being poured into area 68.

FIG. 6 this shows an alternative embodiment of the invention where coving is provided on only one side of a bund wall 69A. In this embodiment bracket 79 has only one upstanding portion 81 and one overhanging lip 49. Alternatively a bracket as shown in FIG. 3 may equally be used although one upstanding portion will be superfluous. Rear surface 83 of bund wall 69A requires conventional form word (not shown) when the wall 69A is being formed and concrete to fill bund wall 69A is being poured.

Figure 7:
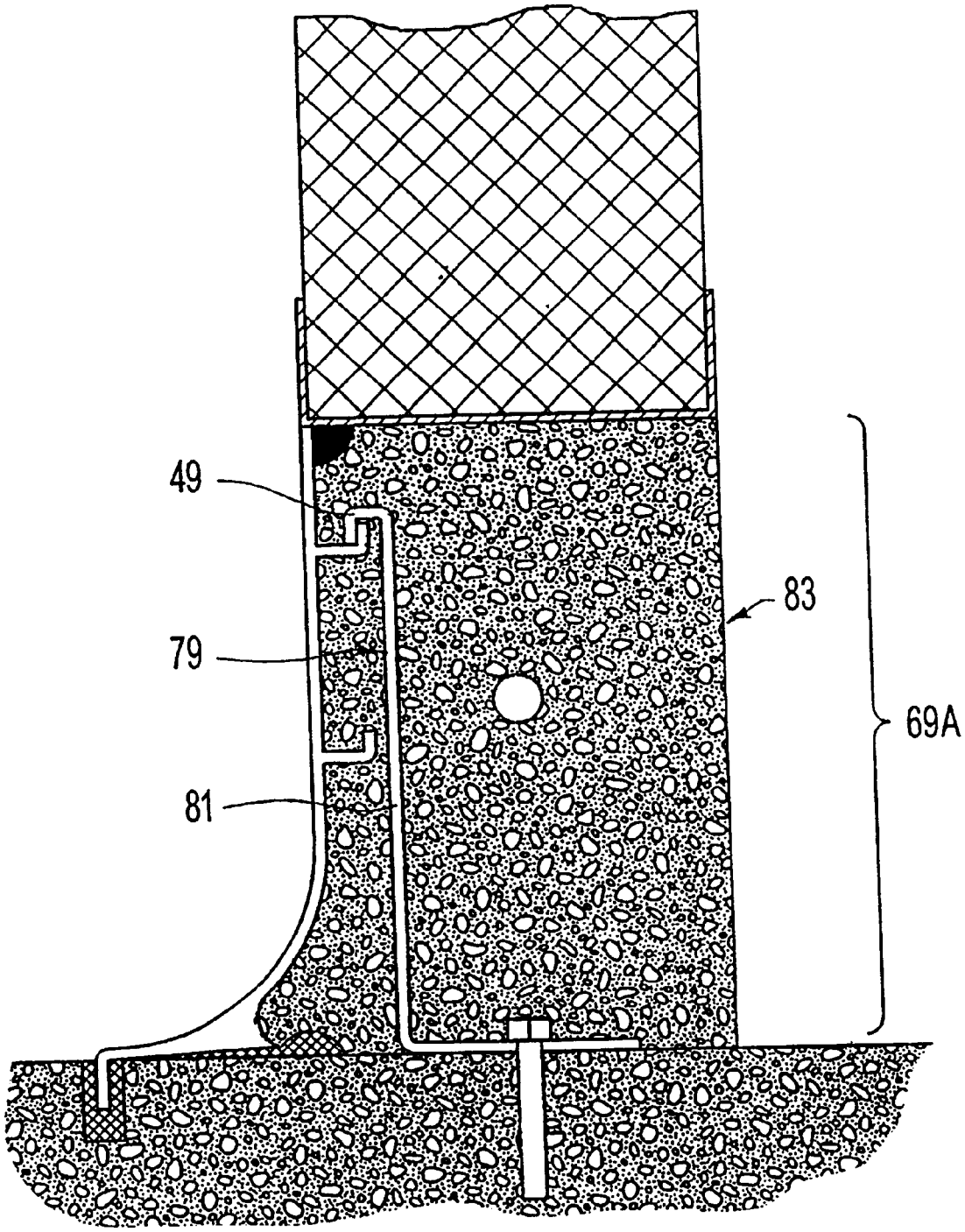
FIG. 7 is a perspective view of an alternative embodiment of the present invention.

In FIG. 7 coving 1 is shown having inclined surface 85. Inclined surface may be of any desired angle or dimensions as may be required by any particular application eg. to improve ability of coving to be cleaned, or for particular building construction methods.

EXAMPLE

Figure 8:
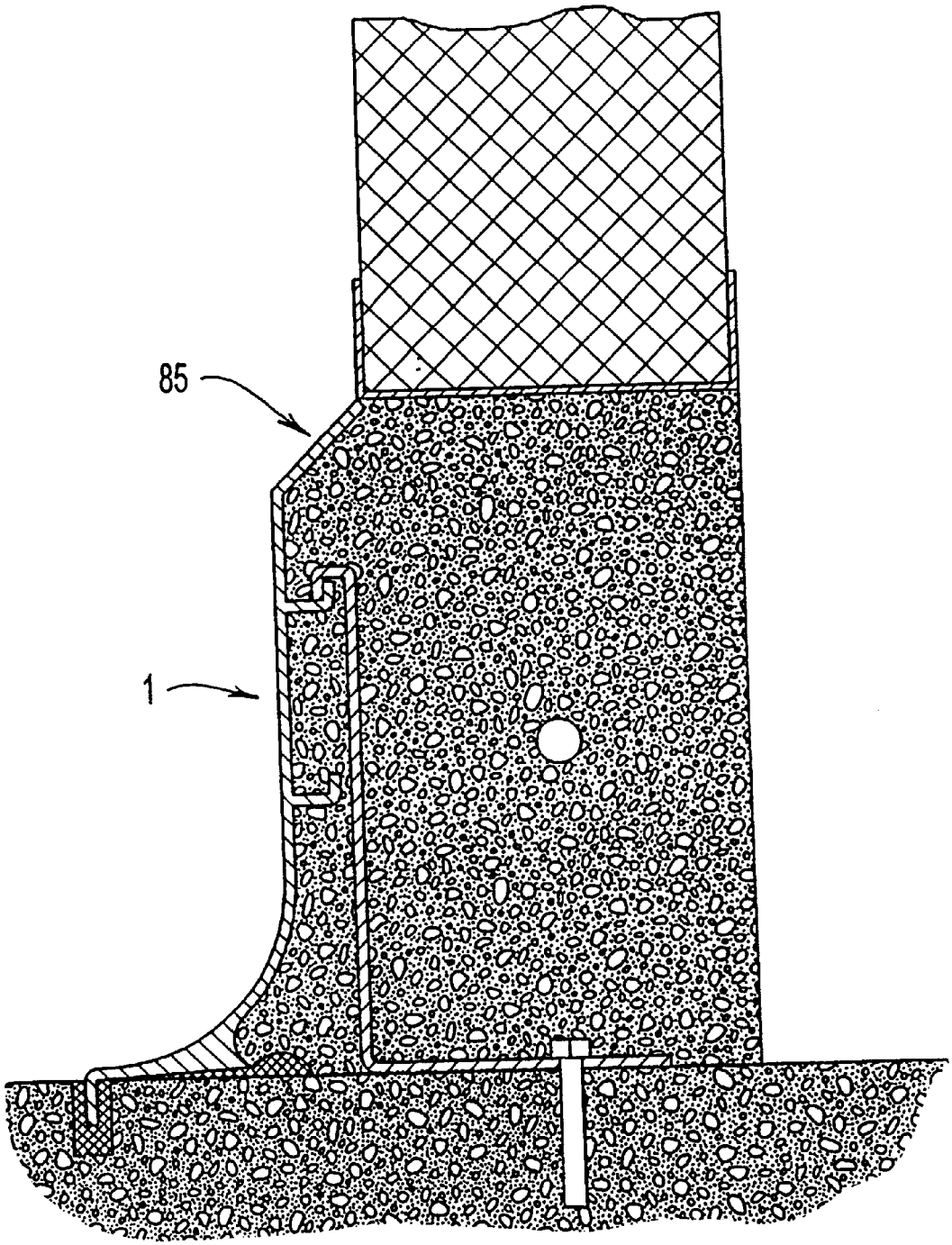
FIG. 8 is a transverse section of a bund wall made in accordance with the present invention showing an alternative configuration of the coving.

Installation of the coving and formation of a bund wall on a floor using the method of the present invention is as follows. After the floor surface onto which the bund wall is to be formed has properly cured, the required positioning of the bund wall is determined. It will be assumed for the purposes of this example that the bund wall is to be formed on a level concrete floor slab, although it will be appreciated that it may be suitable for formation on other surfaces. Furthermore this example relates to formation of a bund wall as illustrated in FIG. 6. If a bund wall as illustrated in FIGS. 7 or 8 it will be apparent to the skilled addressee what modifications to the described method will be necessary.

Two parallel channels wide enough to accommodate the flange of coving are cut by grinding or any other suitable means into the floor surface of the floor slab equally space from the centre-line of the proposed bund wall along the full length of the proposed wall. The distance of the two channels from the centre-line will be predetermined by taking into account the thickness of the bund wall and the dimensions of the covings to be used. Bore holes of suitable dimensions to receive appropriated bolts along the centre-line at desired spacings. The channels are filled with a mastic sealant such as "Thioflex 600"™ or an equivalent epoxy sealant and further beads of sealant are applied to the floor surface between the channels and the centre-line close to the channels.

Covings are then positioned on the floor surface with the flanges of the covings inserted into the respective channels so that the flange is embedded in the uncured sealant. The feet of the respective covings are pressed against the sealant beads until sealant is expelled from underneath the feet away from the flange. The covings should then be adjusted so that the wall portions of the covings are substantially perpendicular to the floor surface.

Brackets are then positioned to engage with the attachment ledges of the covings at sites where the bore holes have been drilled. Suitable bolts such as "Dynabolts"™ or other masonry fasteners are then used to pass through the openings in the respective brackets. Spacers are positioned at suitable spacings on the support ledges of the covings. The bolts or other fasteners are then tightened to firmly secure the covings into position. Such tightening may cause additional expulsion of sealant from underneath the feet.

A reinforcing rod and suitable starters are positioned with the reinforcing rod being suspended in the cavity formed by the covings.

When the sealant has cured to an adequate extent, the cavity formed by the covings may then be filled, generally with concrete. Air bubbles should be avoided and the concave rear face of the covings and the re-entrant portions will assist in ensuring that the concrete comes into close contact with the back of the base portions of the covings. The surface of the concrete where it reaches the upper edges of the covings may be trowelled to a suitable flat state, then the concrete allowed to fully cure.

Once cured, the desired wall structure can then be built on top of the bund wall in the known conventional manner.

Where only one coving is required, when assembling the appropriate formwork, conventional formwork may be used on the side of the bund wall not using the coving of the present-invention.

The coving may be made from any suitable materials known in the art such as steel, stainless steel, thermoplastic polymeric materials, thermosetting polymeric materials or the like. Preferably the coving is made from a thermosetting epoxy composite which is capable of withstanding extremes in temperature and has high impact resistance. The coving may be manufactured using any suitable method, although when the coving is manufactured from an epoxy composite it is preferably formed using a pultrusion process.

Brackets and spacers may be manufactured from any suitable materials. Preferably brackets and spacers are made from steel and bent into the desired shape.

It is to be understood that various modifications, additions, and/or alterations may be made to the configuration previously described without departing from the ambit of the present invention.

What is claimed is:

1. A preformed coving suitable for casting into a bund wall, said coving including:

a base portion positionable on or in close proximity to a floor and having a concave curved front face, a substantially vertically planar dependent flange adapted for location in a recess in said floor, and a foot on a rear face of the base portion adapted to overlie said floor when said dependent flange is located in said recess in said floor, said foot including a sealing surface tangential to said curved front face and being substantially solid in the region between said sealing surface and said curved front face;

a wall portion having a front face; and attachment means remote from said front faces adapted to receive a fixing device for securing said coving to said floor.

2. A preformed coving according to claim 1, wherein said coving is elongate and of substantially constant cross-section and said dependent flange extends along a length of said coving.

3. A preformed coving according to claim 1, wherein the dependent flange depends from a front edge of the base portion which is spaced away from the wall portion.

4. A preformed coving according to claim 1, wherein the sealing surface of said foot when said coving is fixed in its desired position on a floor, is angled relative to said floor and inclined away from where the base portion comes closest to the floor.

5. A preformed coving according to claim 1, wherein said foot has a re-entrant lip between said sealing surface and said base portion.

6. A preformed coving according to claim 1, wherein said attachment means consists of one or more flanges having an upturned lip adapted to engage a downwardly facing fixing bracket.

7. A formwork system for forming a coved wall on a surface, said system including a coving according to claim 1 having a base portion having a concave curved front face;

a wall portion having a front face;

attachment means remote from said front faces adapted to receive a fixing device; and a fixing device cooperable with said attachment means and securable to said surface to secure said roving in position on said surface.

8. A formwork system according to claim 7, wherein said fixing device consists of a bracket having a portion adapted to engage with said attachment means on said coving and another portion adapted to be secured to said surface such that said coving is secured to said surface.

9. A formwork system according to claim 7, wherein there are provided two covings in a back to back relationship and there is further provided spacing means to space the two covings a desired distance apart.

10. A formwork system according to claim 9, wherein there are provided secondary attachment means on said covings adapted to receive said spacing means.

11. A method of forming a bund wall including the steps of:

(a) providing a roving which includes a base portion having a concave curved front face and a substantially vertically planar dependent flange adapted for location in a recess, a wall portion having a front face, and attachment means remote from said front faces adapted to receive a fixing device;

(b) forming a recess in said surface;

(c) positioning said coving on said surface with said front faces displayed outwardly and locating said flange in said recess;

(d) securing said coving to said surface by one or more fixing devices attached to said attachment means and said surface;

(e) providing formwork adjacent to said coving to form a space between the rear of said coving and said formwork; and (f) providing infill to said space.

12. A method according to claim 11, wherein the formwork provided adjacent said coving consists of a further preformed coving.

13. A method according to claim 12, including the step of positioning a plurality of space means along a length of said covings prior to providing infill to said space.

14. A method according to claim 11, including the step of providing reinforcing means in said space prior to providing infill to said space.

15. A method according to claim 11, including the step of applying a sealing material in the recess prior to locating said flange in said recess.

* * * * *